US008763409B2

(12) United States Patent
Newman et al.

(10) Patent No.: US 8,763,409 B2
(45) Date of Patent: Jul. 1, 2014

(54) LNG (LIQUEFIED NATURAL GAS) AND LIN (LIQUID NITROGEN) IN TRANSIT REFRIGERATION HEAT EXCHANGE SYSTEM

(75) Inventors: Michael D. Newman, Hillsborough, NJ (US); Stephen A. McCormick, Warrington, PA (US)

(73) Assignee: Linde Aktiengesellschaft, Munich (DE)

( * ) Notice: Subject to any disclaimer, the term of this patent is extended or adjusted under 35 U.S.C. 154(b) by 515 days.

(21) Appl. No.: 13/177,618

(22) Filed: Jul. 7, 2011

(65) Prior Publication Data

US 2013/0008631 A1 Jan. 10, 2013

(51) Int. Cl.

| | |
|---|---|
| ***F25B 19/00*** | (2006.01) |
| ***F28F 7/02*** | (2006.01) |
| ***F28D 15/02*** | (2006.01) |
| *F28D 21/00* | (2006.01) |

(52) U.S. Cl.

CPC ..... *F28D 15/0275* (2013.01); *F28F 7/02* (2013.01); *F28D 2021/0033* (2013.01)

USPC ..... 62/7; 62/239; 62/434

(58) Field of Classification Search

CPC ..... F25B 19/00; F25B 19/005; F17C 9/04; F17C 9/02; F25D 17/067; F24F 1/0007

USPC ..... 62/7, 50.3, 53.2, 239, 431, 432, 434, 62/428; 165/104.34, 104.26

See application file for complete search history.

(56) References Cited

U.S. PATENT DOCUMENTS

| | | | | |
|---|---|---|---|---|
| 2,153,942 A | | 4/1939 | Spaiding | |
| 2,499,736 A | | 3/1950 | Kleen | |
| 3,714,793 A | | 2/1973 | Eigenbrod | |
| 3,934,643 A | | 1/1976 | Laing | |
| 4,538,423 A | | 9/1985 | Le Diouron | |
| 4,600,050 A | | 7/1986 | Noren | |
| 4,673,030 A | | 6/1987 | Basiulis | |
| 4,706,739 A | * | 11/1987 | Noren | 165/104.14 |
| 4,981,019 A | | 1/1991 | Hicks et al. | |
| 5,123,479 A | * | 6/1992 | Pravda | 165/86 |
| 5,343,632 A | * | 9/1994 | Dinh | 34/507 |
| 5,373,700 A | | 12/1994 | McIntosh | |

(Continued)

FOREIGN PATENT DOCUMENTS

| | | | |
|---|---|---|---|
| DE | 10 2006 046931 A1 | 4/2008 | |
| EP | 0 657 107 A1 | 6/1995 | |

(Continued)

OTHER PUBLICATIONS

European Search Report for EP 11 17 6637, Date of Mailing: Feb. 1, 2012, Authorized Officer: Frank Mootz, 6 pp.

European Search Report for EP 11 17 9115, Date of Mailing: Feb. 23, 2012, Authorized Officer: Fernandez Ambres, 7 pp.

(Continued)

*Primary Examiner* — Mohammad M Ali

(74) *Attorney, Agent, or Firm* — Joshua L. Cohen

(57) ABSTRACT

A heat exchanger includes a housing disposed in a first atmosphere and having an upstream end, a downstream end and a chamber within the housing; a metallic block disposed in the chamber and having a passageway therethrough and through which a cryogen can flow; and a heat pipe assembly in contact with the metallic block and extending to a second atmosphere which is separate from the first atmosphere for providing heat transfer at the second atmosphere.

28 Claims, 4 Drawing Sheets

(56) References Cited

U.S. PATENT DOCUMENTS

| | | | | |
|---|---|---|---|---|
| 5,523,563 | A * | 6/1996 | Moessner | 250/238 |
| 5,651,414 | A * | 7/1997 | Suzuki et al. | 165/104.14 |
| 5,704,415 | A * | 1/1998 | Suzuki et al. | 165/104.26 |
| 6,026,891 | A * | 2/2000 | Fujiyoshi et al. | 165/104.33 |
| 6,430,938 | B1 | 8/2002 | Royal | |
| 7,124,806 | B1 | 10/2006 | Wang | |
| 7,322,401 | B2 * | 1/2008 | Kim | 165/104.21 |
| 7,436,667 | B2 * | 10/2008 | Wu et al. | 361/700 |
| 2003/0029179 | A1 | 2/2003 | Vander Woude et al. | |
| 2005/0034477 | A1 | 2/2005 | Hu | |
| 2007/0169920 | A1 * | 7/2007 | Yang | 165/104.34 |
| 2008/0104971 | A1 | 5/2008 | Sami | |
| 2009/0277188 | A1 | 11/2009 | Teegen | |
| 2010/0132923 | A1 | 6/2010 | Batty et al. | |

FOREIGN PATENT DOCUMENTS

| | | | |
|---|---|---|---|
| EP | 1 045 219 | A1 | 10/2000 |
| EP | 2 384 916 | A1 | 11/2011 |
| GB | 1 604 421 | A | 12/1981 |
| GB | 2 275 098 | A | 8/1994 |
| JP | 59 027191 | A | 2/1984 |
| JP | 11 041863 | A | 2/1999 |
| NL | 7 508 958 | A | 2/1977 |
| WO | WO 93/17292 | | 9/1993 |
| WO | WO 2009/153515 | A1 | 12/2009 |

OTHER PUBLICATIONS

International Search Report for PCT/US12/31435, Date of Mailing: Jun. 27, 2012, Authorized Officer: Lee W. Young, 10 pp.

* cited by examiner

LNG (LIQUEFIED NATURAL GAS) AND LIN (LIQUID NITROGEN) IN TRANSIT REFRIGERATION HEAT EXCHANGE SYSTEM

BACKGROUND

The present embodiments relate to heat transfer for refrigerating spaces such as for example spaces that are in transit.

In transit refrigeration (ITR) systems are known and may include cryogenic ITR systems which use fin tube heat exchangers for liquid nitrogen and carbon dioxide chilled or frozen applications, or a snow bunker for solid $CO_2$ snow (dry ice) chilled or frozen applications. Such known systems experience problems of safety, temperature control, cold down rates, dual temperature zone control, efficiency and fouling.

BRIEF DESCRIPTION OF THE DRAWINGS

For a more complete understanding of the present embodiments, reference may be had to the following drawing figures taken in conjunction with the description of the embodiments, of which.

DETAILED DESCRIPTION OF THE INVENTION

Heat pipes can be used instead of known fin tube heat exchangers to achieve comparable heat transfer with minimal air surface contact area, thereby eliminating issues resulting from snow accumulation on heat exchanger fins. In addition, the thermal conductivity of heat pipes can be adjusted to deliver precise heat transfer rates to the system by using variable conductivity heat pipes.

Figure 1:
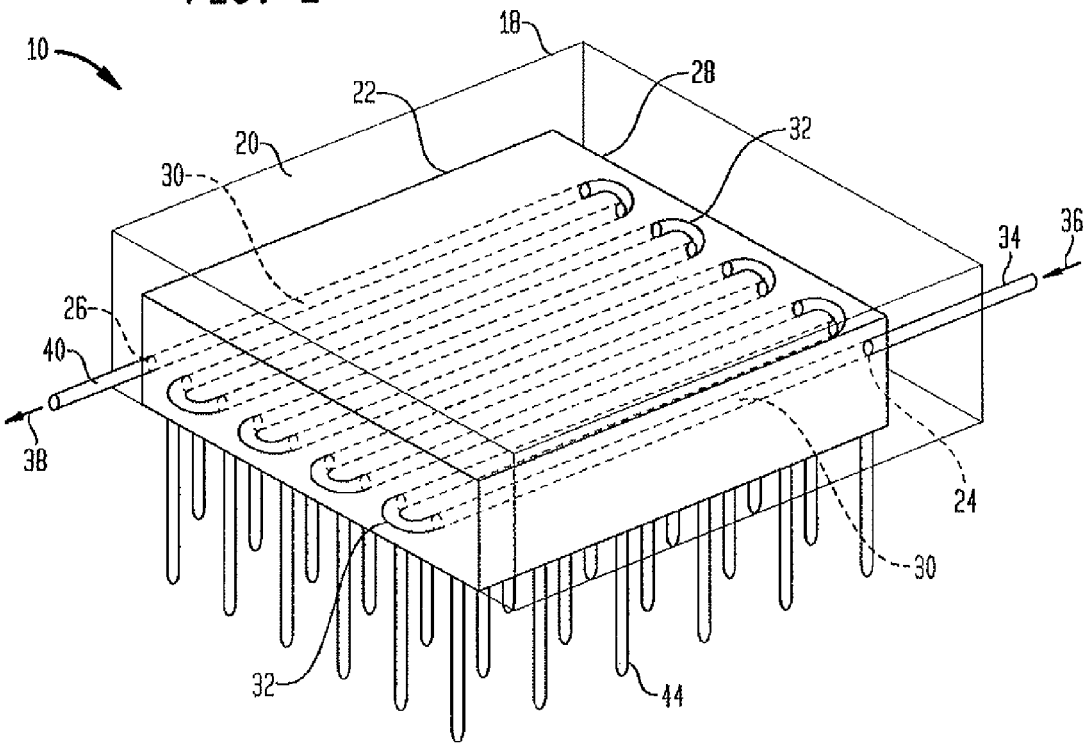
FIG. 1 shows a perspective isometric view of a cryogen heat exchanger embodiment according to the present invention.
Figure 2:
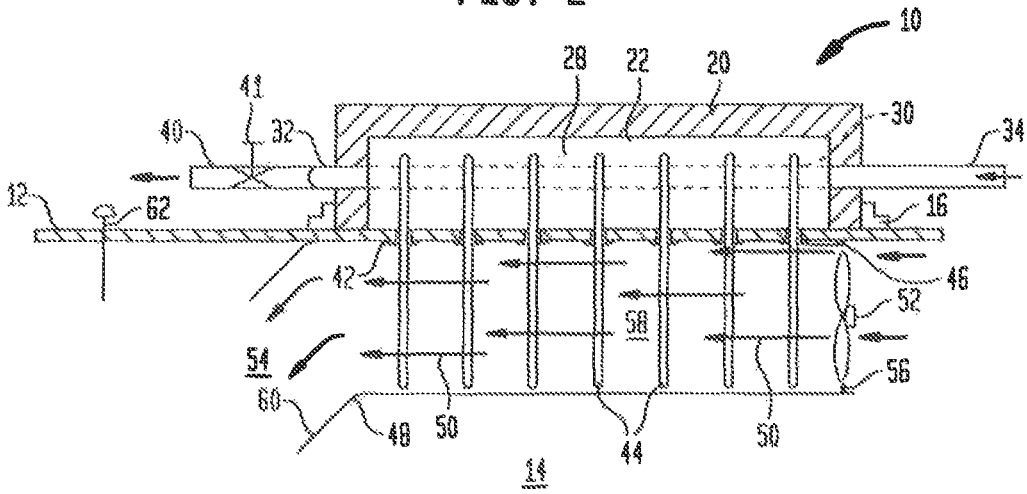
FIG. 2 shows a side view in cross-section of the embodiment in FIG. 1.

Referring to FIGS. 1-2, a cryogen heat exchanger embodiment is shown generally at 10. The heat exchanger 10 is mounted for use with a compartment having a sidewall 12 defining a space 14 in the compartment. The heat exchanger 10 can be mounted to the sidewall 12 by mechanical fasteners 16, such as for example brackets. The sidewall 12 may be insulated or vacuum jacketed.

The heat exchanger 10 includes a housing 18. The housing 18 includes an insulated sidewall 20 defining an internal chamber 22 in the housing. An inlet 24 and an outlet 26 at the sidewall are in communication with the internal chamber 22. A solid conductive metallic block 28 is disposed in the internal chamber 22.

The metallic block 28 can have a rectangular cross section as shown in FIGS. 1-2, or can be formed with a cross section having another shape. Copper is one type of material which may be used for forming the metallic block 28 by way of example only, as other metals or alloys may be used, provided such are highly conductive and have sufficient heat transfer capabilities, i.e. highly thermally conductive. An internal area of the block 28 is formed with a plurality of bores 30, channels or passages as shown in particular in FIG. 1. The plurality of passages 30 form a continuous internal flow path in a serpentine pattern within the block 28. A "serpentine pattern" as used herein refers to a pattern that is winding or turning one way and another. Tubes 32 interconnect adjacent ones of the plurality of passages 30, thereby providing for the continuous internal flow path. It may be from the construction of the metallic block 28 that the tubes 32 are observable from an exterior of the apparatus 10, thereby providing an indication of the plurality of passages 30 within the block 28, although this is not required for operation of the apparatus 10.

A liquid cryogen, such as liquid nitrogen (LIN), is provided through a cryogen inlet pipe 34 to the inlet 24 in communication with one of the passages 30 in the block 28, as indicated by arrow 36. The liquid cryogen enters one end of the block 28 and flows through the internal flow path to an opposite or terminating end of the flow path, where it is discharged through the outlet 26 as a cryogenic gas or vapor 38 through a vapor outlet pipe 40 in communication with the outlet 26. In this example, the liquid nitrogen would be discharged as gaseous nitrogen from the outlet pipe 40. This is the case the liquid nitrogen changes to a gas phase as it is warmed during its flow thorough the plurality of the passages 30 of the metallic block 28. The outlet pipe 40 may include a modulating type valve 41 which is used to control the mass flow rate of cryogen flowing through the block 28.

Referring to FIG. 1, the sidewall 12 of the compartment space 14 is formed with holes 42 extending therethrough, such that when the apparatus 10 is mounted to the wall 12 each one of the holes 42 will receive a corresponding one of a plurality of heat pipes 44 extending from within the metallic block 28 through the holes 42 and into the space 14 of the compartment. The heat pipes 44 may be provided as shown in an assembly or in an array. Seals 46 or gasketing in the sidewall 12 prevent leakage or seepage of cryogen liquid and vapour into the compartment space 14. Seals or gasketing is required if the heat pipes 44 penetrate into one of many of the passages 30 in the metallic block 28. If the heat pipes 44 terminate in the solid block 28 only, then there is little if any possibility of cryogen liquid and vapor entering the compartment space 14.

By way of example only, any number of heat pipes 44 may be used, depending upon the chilling or freezing application to be employed within the space 14, the products in the space and the volume of the space. By way of example only, 25-100 heat pipes may be used. Each one of the heat pipes 44 extends approximately 6"-12" into the space 14. The positioning of the heat pipes 44 is such that an end portion of each one of the heat pipes is embedded in the block 28, while an opposite end portion of each one of the heat pipes is exposed to the atmosphere of the space 14. Accordingly, the extreme cold of the liquid cryogen is transferred by conduction from the metallic block 28 through each heat pipe 44 to an opposite end of each one of the heat pipes exposed to the space 14 atmosphere, such that heat is transferred from the space 14 atmosphere to the cryogen 36 where it experiences a phase change and boils off. The gaseous or cryogen vapor 38 is vented or exhausted through the outlet pipe 40 to the atmosphere external to the apparatus 10.

At a position where the heat pipes 44 protrude into the space 14 there is provided a shield 48 or shroud to protect the heat pipes from any products within or shifting about the space 14 of the compartment. The shroud 48 also facilitates air flow, represented generally by arrows 50 created by a circulation device 52, such as a fan for example, or a plurality of fans, across the heat pipes 44 for a higher heat transfer rate proximate the heat pipes. Accordingly, the temperature of the air flow downstream of the heat pipes 44 at a position generally represented at 54 is lower than a temperature of the air flow upstream of the heat pipes proximate the fan 52. The shroud 48 may be fabricated from metal. A plurality of fans 52 may be used to increase net heat transfer effect.

The fan 52 or plurality of fans are mounted at a shroud inlet 56 for drawing air from the space 14 into the inlet and moving the air through a shroud space 58 or channel for discharge back into the space, as indicated by the arrows 50 showing said air flow through the shroud. An outlet 60 of the shroud may have a curved or arcuate portion, as shown in FIG. 2, to direct the airflow 50 back to a more centralized region of the space 14.

Heat from the warm air drawn in by the fans 52 is transferred via the heat pipes 44 to the colder solid metallic block 28 in which is contained the flow of cryogen. The thermal conductivity of the heat pipes 44 can be adjusted by selecting different sizes of heat pipes or different materials from which the heat pipes are fabricated, and/or adjusting the fan speed to match the required refrigeration load of the heat exchanger embodiment 10. In addition, variable conductivity heat pipes can be used for the pipes for active control of the heat flux or heat transfer to provide a wide range of heat flux and temperature gradients at the pipes 44 and to the airflow 50. A sensor 62 mounted at the sidewall 12 for example is used to sense temperature of the space 14 downstream of the shroud outlet 60.

As mentioned above, the temperature of the space 14 can be controlled by varying the rate of the air flow across the heat pipes 44. That is, if for example, the space 14 is to maintain a chilled temperature, such as for a vegetable food product for example, the fan(s) speed can be adjusted to thereby effect the heat transfer rate of the heat pipes 44 and controlling internal temperature of the space 14. If a frozen food product is in the space 14, then the fan speed would be adjusted to provide a higher heat transfer rate of the air flow 50 across the heat pipes 44.

Figure 3:
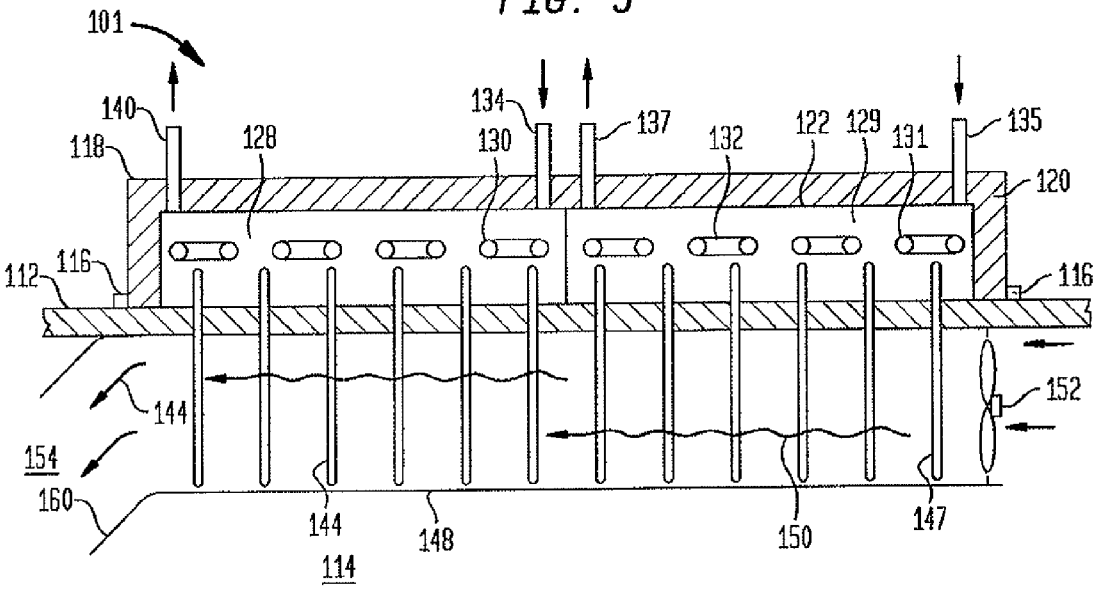
FIG. 3 shows a side view in cross-section of another embodiment of a cryogen heat exchanger according to the present invention.
Figure 4:
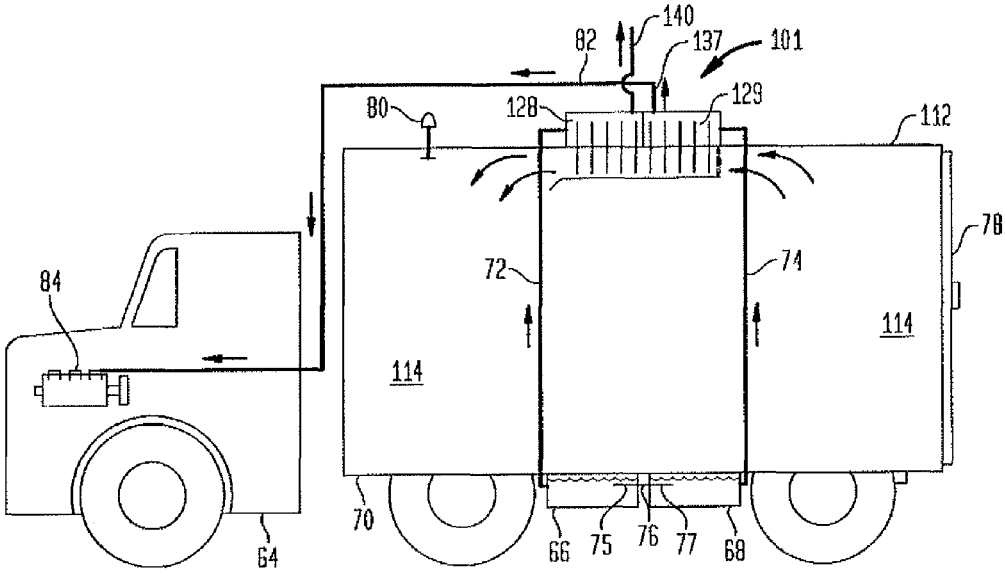
FIG. 4 shows a side view of the embodiment of FIG. 3 mounted for use with an ITR platform, such as a truck for example.

FIG. 3 shows another embodiment 101 of the heat exchange apparatus for use with for example an ITR truck or other intermodal transportation vehicle. Elements illustrated in FIGS. 3 and 4 which correspond to the elements described above with respect to FIGS. 1-2 have been designated by corresponding reference numerals increased by 100, respectively. The embodiments of FIGS. 3 and 4 are designed for use in the same manner as the embodiment of FIGS. 1 and 2, unless otherwise stated.

The embodiment 101 includes a housing 118 with an internal chamber 122 sized and shaped to receive a pair of metallic blocks 128,129. The metallic block 128 is similar to that described above with respect to the embodiment of FIGS. 1-2. The metallic block 129 can also be of a similar metallic construction as that of block 128, however the block 129 will receive liquid natural gas at an inlet pipe 135 which will phase shift to a gas during its flow through passageway 131, which can also have a serpentine pattern, to be discharged at outlet pipe 137 as natural gas.

The metallic blocks 128,129 are adjacent each other or nested together in the internal chamber 122 of the housing 118. The heat pipes 144 which coact with the metallic block 128 can be disposed such that an end portion of the heat pipes 144 can terminate either in the metallic block 128 andfor in the passages 130. In contrast, heat pipes 147 which are disposed for coaction with the metallic block 129 all have an end portion which terminates within the metallic block 129. That is, none of the heat pipes 129 terminate in or are in contact with the passages 131.

As shown in FIG. 3, liquid nitrogen can be provided to the inlet pipe 134 for said liquid nitrogen to be provided to the passages 130 of the metallic block 128. The heat transfer which occurs with respect to the heat pipes 144 causes the liquid nitrogen to phase to gas such that gaseous nitrogen is exhausted through the outlet pipe 140.

Liquid natural gas may be provided by the inlet pipe 135 for introduction to the passages 131 of the metallic block 129. The liquid natural gas experiences a phase change and is exhausted as natural gas through outlet pipe 137. The use of the heat pipes 144,147 with their corresponding metallic blocks 128,129, respectively, enable two separate refrigerated liquids to be introduced and used in series such that the LNG block 129 may be used first for example, followed by the liquid nitrogen block 128. Therefore, the air flow 150 is cooled or refrigerated first by exposure to the heat pipes 147 coacting with the metallic block 129, afterwhich further cooling or refrigeration of the air flow 150 occurs upon contact with the heat pipes 144 coacting with the metallic block 128.

Referring to FIG. 4, the cryogen heat pipe heat exchanger embodiment 101 is mounted to a compartment or trailer of a truck 64 or other in transit vehicle or mode of transportation to provide ITR. Although the heat pipe heat exchanger may be mounted anywhere along the sidewall 112 of the compartment space 114, a top (as shown) or side mounted embodiment is more desirable because the shroud 148 and heat pipes 144,147 protruding into the compartment will be exposed to and consume valuable floor space for pallets (not shown) or other products that would be deposited on a floor of the compartment. Mounting the cryogen heat pipe heat exchanger to the top of the compartment, as opposed to the bottom of the compartment, will also protect the shroud and heat pipes extending into the compartment from being damaged due to products or pallets shifting within the compartment.

As shown in FIG. 4, for the embodiment 101 of FIG. 3 mounted to the top of the compartment of the truck, pipe(s) would be used to connect tanks of liquid nitrogen and liquid natural gas for this embodiment.

The cryogen heat pipe heat exchanger 101 shown mounted to the top of the compartment space 114 is constructed and arranged to be provided with liquid cryogen through pipes 72,74 connected to liquid cryogen storage vessels 66,68. In this embodiment, the vessel 66 contains liquid nitrogen, and the vessel 68 contains liquid natural gas. The vessels 66,68 are the source for the liquid cryogen during for example ITR. The vessels 66,68 may be mounted for operation beneath a bottom 70 of the compartment space 114. The vessels 66,68 have sidewalls which are vacuum jacketed or surrounded by insulation material, and the pipes 72,74 distributing the liquid cryogen to the exchanger 101 may also be insulated or vacuum jacketed. The vessels 66,68 are maintained under a pressure at a range from of 2 to 8 Barg to force the liquid cryogen from the vessels through the pipes 72,74 and into the heat exchanger 101.

A heat pipe 76 extends between the vessels 66,68 with one end 75 of the heat pipe 76 in communication with liquid nitrogen in the vessel 66, and an opposite end 77 of the heat pipe 76 in communication with liquid natural gas in vessel 68. The heat pipe 76 may be a variable conductance heat pipe having the opposed ends 75,77 disposed in the liquid storage vessels 66,68. Since liquid nitrogen (LIN) is colder than liquid natural gas (LNG), heat can be transferred from the LNG vessel to the LIN vessel, thereby recondensing any gaseous LNG in the vessel 68. The heat pipe 76 may be disposed in a head space (vapor area) of each of the vessels 66,68, or for a more effective heat phase change, the end 75 of the heat pipe 76 may be disposed in the liquid nitrogen, while the end 77 of the heat pipe 76 may be disposed in the head space (vapor area) of the vessel 68.

A sensor 80 is mounted for sensing the temperature in the space 114 and can be connected to a control panel (not shown) for receiving a signal of the temperature sensed and then adjusting the amount of liquid cryogen flow necessary from each one of the vessels 66,68, depending upon the temperature that must be obtained and maintained in the space. Sensor probes, such as for example capacitance probes (not shown), may also be mounted to each one of the corresponding vessels 66,68 to sense the level of the cryogen liquid in the corresponding vessel and generate a signal of same which is transmitted to the control panel (not shown). Temperature in the vessels 66,68 is not controlled, but rather the heat pipe 76 is used to phase change the vapor in the head space of the tank 68 so that no LNG needs to be vented to the atmosphere. This provides for a stable, constant pressure in the vessel 68 so that LNG does not have to be vented. There is however, no problem with venting the LNG from the tank 66. Temperatures in the compartment space 114 can also be maintained by adjusting the pressure in the vessel 66 or with the use of variable conductance heat pipes as discussed above. As shown in FIG. 4, a door 78 provides access to the compartment 114.

A pipe 82 may be connected to the exhaust pipe 137 to direct the natural gas to an engine 84 of the truck 64. The pipe 82 can be jacketed or insulated, although not necessary. The gaseous LNG from the heat exchanger 101 is fed directly to the engine 84 to power the truck 64, while the gaseous nitrogen is discharged or vented by the pipe 140 to the atmosphere. The demand by the engine 84 will determine the demand upon the amount of LNG to be provided from the heat exchanger 101 through the pipe 82 to the engine 84.

The pipes 72,74 can also be insulated or jacketed if disposed at an exterior of the sidewall 112. Alternatively, the pipes 72,74 can be disposed inside the compartment 114 or possibly embedded in the wall 112 of the compartment.

All of the embodiments discussed above with respect to FIGS. 2-4 also provide for gasketing or seals such as those called for in FIG. 1, where the heat pipes extend through the wall of the tank and the wall of the compartment.

The compartment of FIG. 4 may be mounted or constructed as a part of the truck 64, trailer, automobile, railcar, flatbed, barge, shipping container or other floating vessel, etc., hence the ability to provide in-transit refrigeration (ITR).

It will be understood that the embodiments described herein are merely exemplary, and that one skilled in the art may make variations and modifications without departing from the spirit and scope of the invention. All such variations and modifications are intended to be included within the scope of the invention as described and claimed herein. Further, all embodiments disclosed are not necessarily in the alternative, as various embodiments of the invention may be combined to provide the desired result.

What is claimed is:

1. A heat exchanger, comprising:

a housing disposed in a first atmosphere and having an upstream end, a downstream end and a chamber within the housing;

a first metallic block disposed in the chamber the first metallic block comprising:

a first passageway extending therethrough and through which a first cryogen can flow, the first cryogen comprising a cryogenic substance selected from the group consisting of liquid nitrogen and liquid natural gas, and the first passageway comprising a first inlet port at the upstream end of the housing and a first outlet port at the downstream end of the housing;

a first inlet pipe in communication with the first inlet port for providing the first cryogen to the first passageway;

a first outlet pipe in communication with the first outlet port for exhausting cryogenic vapor from the first passageway to power an engine; and a first heat pipe assembly in contact with the first metallic block and extending to a second atmosphere which is separate from the first atmosphere for providing heat transfer at the second atmosphere.

2. The heat exchanger of claim 1, wherein the first heat pipe assembly comprises at least one heat pipe.

3. The heat exchanger of claim 1, wherein the first heat pipe assembly comprises a plurality of heat pipes of varying lengths, wherein each one of the plurality of heat pipes extends into the second atmosphere.

4. The heat exchanger of claim 1, wherein the first passageway is arranged in a serpentine pattern within the first metallic block.

5. The heat exchanger of claim 1, wherein the first heat pipe assembly comprises a first plurality of heat pipes of which at least one of said heat pipes extends into the first passageway for exposure to the first cryogen.

6. The heat exchanger of claim 1, further comprising a first outlet valve in communication with the first outlet pipe for controlling the cryogenic vapor exhausted and input of the first cryogen to the first passageway.

7. The heat exchanger of claim 1, further comprising a shroud housing disposed in the second, atmosphere and having a channel therein sized and shaped to receive the first heat pipe assembly, a shroud inlet disposed proximate an upstream end of the shroud housing and in communication with the channel, and a shroud outlet disposed proximate a downstream end of the shroud housing and in communication with the channel.

8. The heat exchanger of claim 7, further comprising at least one air circulation device disposed at the upstream end of the shroud housing and exposed to the second atmosphere for directing the second atmosphere to flow through the channel to contact the first heat pipe assembly.

9. The heat exchanger of claim 1, wherein the housing is mounted in the first atmosphere to a wall separating the first atmosphere from the second atmosphere.

10. The heat exchanger of claim 9, wherein the wall is part of a mode of in-transit refrigeration (ITR) selected from the group consisting of a truck, trailer, automobile, barge, shipping container and railcar.

11. The heat exchanger of claim 1, further comprising a tank having a side wall defining a space in the tank for containing the first cryogen, and a first pipe having a first end in communication with the first cryogen in the space and a second end in communication with the first inlet pipe.

12. The heat exchanger of claim 1, further comprising a second metallic block disposed in the chamber proximate the first metallic block, the second metallic block having a second passageway extending therethrough and through which a second cryogen can flow; and a second heat pipe assembly in contact with the second metallic block and extending to the second atmosphere for providing heat transfer at the second atmosphere.

13. The heat exchanger of claim 12, wherein the first passageway is constructed to receive the first cryogen comprising liquid nitrogen, and the second passageway is constructed to receive the second cryogen comprising liquid natural gas.

14. The heat exchanger of claim 13, further comprising a first tank holding the liquid nitrogen, and a first pipeline connecting the first tank to the first passageway; and a second tank holding the liquid natural gas, and a second pipeline connecting the second tank to the second passageway.

15. The heat exchanger of claim 14, further comprising another heat pipe extending between and in communication with an interior of each of the first and second tanks for phase changing vapor in the second tank into liquid.

16. The heat exchanger of claim 12, wherein the first and second metallic blocks are each constructed from a thermally conductive metallic alloy selected from the group consisting of copper and copper-nickel alloy.

17. A heat exchanger, comprising:

a housing disposed in a first atmosphere and having an upstream end, a downstream end and a chamber within the housing;

a first metallic block disposed in the chamber and having a first passageway extending therethrough and through which a first cryogen can flow;

a first heat pipe assembly in contact with the first metallic block and extending to a second atmosphere which is separate from the first atmosphere for providing heat transfer at the second atmosphere; and a wall separating the first atmosphere from the second atmosphere and to which the housing is mounted, wherein the wall is part of a mode of in-transit refrigeration (ITR) selected from the group consisting of a truck, trailer, automobile, barge, shipping container and railcar.

18. The heat exchanger of claim 17, wherein the first heat pipe assembly comprises at least one heat pipe.

19. The heat exchanger of claim 17, wherein the first heat pipe assembly comprises a plurality of heat pipes of varying lengths, wherein each one of the plurality of heat pipes extends into the second atmosphere.

20. The heat exchanger of claim 17, wherein the first passageway is arranged in a serpentine pattern within the first metallic block.

21. The heat exchanger of claim 17, wherein the first heat pipe assembly comprises a first plurality of heat pipes of which at least one of said heat pipes extends into the first passageway for exposure to the first cryogen.

22. The heat exchanger of claim 17, wherein the first cryogen comprises a cryogenic substance selected from the group consisting of liquid nitrogen and liquid natural gas.

23. The heat exchanger of claim 17, further comprising a shroud housing disposed in the second atmosphere and having a channel therein sized and shaped to receive the first heat pipe assembly, a shroud inlet disposed proximate an upstream end of the shroud housing and in communication with the channel, and a shroud outlet disposed proximate a downstream end of the shroud housing and in communication with the channel.

24. The heat exchanger of claim 23, further comprising at least one air circulation device disposed at the upstream end of the shroud housing and exposed to the second atmosphere for directing the second atmosphere to flow through the channel to contact the first heat pipe assembly.

25. The heat exchanger of claim 17, further comprising a second metallic block disposed in the chamber proximate the first metallic block, the second metallic block having a second passageway extending therethrough and through which a second cryogen can flow; and a second heat pipe assembly in contact with the second metallic block and extending to the second atmosphere for providing heat transfer at the second atmosphere.

26. The heat exchanger of claim 25, wherein the first and second metallic blocks are each constructed from a thermally conductive metallic alloy selected from the group consisting of copper and copper-nickel alloy.

27. A heat exchanger, comprising;

a housing disposed in a first atmosphere and having an upstream end, a downstream end and a chamber within the housing;

a metallic block disposed in the chamber and having a passageway extending therethrough and through which a cryogen can flow, the passageway comprising an inlet port and an outlet port;

an inlet pipe in communication with the inlet port at the upstream end of the housing for providing the cryogen to the passageway;

an outlet pipe in communication with the outlet port at the downstream end of the housing for exhausting cryogenic vapor from the passageway;

a heat pipe assembly in contact with the metallic block and extending to a second atmosphere which is separate from the first atmosphere for providing heat transfer at the second atmosphere;

a tank having a side wall defining a space in the tank for containing the cryogen; and a pipe comprising a first end in communication with the cryogen in the space and a second end in communication with the inlet pipe.

28. A heat exchanger, comprising:

a housing disposed in a first atmosphere and having an upstream end, a downstream end and a chamber within the housing;

a first metallic block disposed in the chamber and having a first passageway extending therethrough and through which a first cryogen comprising liquid nitrogen can flow;

a first heat pipe assembly in contact with the first metallic block and extending to a second atmosphere which is separate from the first atmosphere for providing heat transfer at the second atmosphere; and a second metallic block disposed in the chamber proximate the first metallic block, the second metallic block having a second passageway extending therethrough and through which a second cryogen comprising liquid natural gas can flow; and a second heat pipe assembly in contact with the second metallic block and extending to the second atmosphere for providing heat transfer at the second atmosphere.

* * * * *